US007701310B2

(12) United States Patent
Fujita

(10) Patent No.: US 7,701,310 B2
(45) Date of Patent: Apr. 20, 2010

(54) DIELECTRIC SUBSTRATE FOR WAVE GUIDE TUBE AND TRANSMISSION LINE TRANSITION USING THE SAME

(75) Inventor: Akihisa Fujita, Anjo (JP)

(73) Assignee: Denso Corporation, Kariya (JP)

( * ) Notice: Subject to any disclaimer, the term of this patent is extended or adjusted under 35 U.S.C. 154(b) by 52 days.

(21) Appl. No.: 11/801,718

(22) Filed: May 10, 2007

(65) Prior Publication Data

US 2007/0262828 A1 Nov. 15, 2007

(30) Foreign Application Priority Data

May 12, 2006 (JP) ..... 2006-134091

(51) Int. Cl.
*H01P 5/107* (2006.01)

(52) U.S. Cl. ..... 333/26

(58) Field of Classification Search ..... 33/26, 33/248

See application file for complete search history.

(56) References Cited

U.S. PATENT DOCUMENTS 2,812,501 A * 11/1957 Sommers ..... 333/238
5,793,263 A * 8/1998 Pozar ..... 333/26
5,982,250 A * 11/1999 Hung et al. ..... 333/26
6,239,669 B1 * 5/2001 Koriyama et al. ..... 333/26
6,580,335 B1 * 6/2003 Iizuka et al. ..... 333/26
6,958,662 B1 * 10/2005 Salmela et al. ..... 333/26
2003/0042993 A1 * 3/2003 Sayanagi et al. ..... 333/26

FOREIGN PATENT DOCUMENTS

JP 10-190317 7/1998
JP 2001-196815 7/2001

OTHER PUBLICATIONS

Office action dated Jan. 22, 2009 in German application No. 10 2007 021615.9.

* cited by examiner

*Primary Examiner*—Benny Lee
(74) *Attorney, Agent, or Firm*—Harness, Dickey & Pierce, PLC

(57) ABSTRACT

A transmission line transition includes a waveguide tube section having a waveguide tube, a waveguide tube section that is formed of at least a dielectric substrate and a line transition section formed of at least a dielectric substrate disposed adjacent the waveguide tube section to cover the hole, a transmission line for transmitting the electromagnetic wave, and an antenna pattern that is disposed in the hole to be electromagnetically coupled with the transmission line. Each of the dielectric substrates has a plurality. of via holes disposed to surround the hole at a distance δ=an integer n×wave length λg/2 from the peripheral wall of the hole.

4 Claims, 6 Drawing Sheets

DIELECTRIC SUBSTRATE FOR WAVE GUIDE TUBE AND TRANSMISSION LINE TRANSITION USING THE SAME

CROSS REFERENCE TO RELATED APPLICATION

The present application is based on and claims priority from Japanese Patent Application 2006-134091, filed May 12, 2006, the contents of which are incorporated herein by reference.

BACKGROUND OF THE INVENTION

1. Field of the Invention

The present invention relates to a dielectric substrate and a device that utilizes the electric substrate, such as a waveguide or a transmission line transition.

2. Description of the Related Art

Usually, a waveguide tube is formed of a plural dielectric substrates (only one illustrated in FIG. 8) each of which has a hole or a cavity (H). The peripheral wall of the hole is coated with a conductive film, as disclosed in JP-P3347626. When manufacturing a waveguide tube, conductive ink is printed on the peripheral wall to form a conductive film. However, it is difficult to form a flat conductive film due to the surface tension thereof as shown in FIG. 8. Further, an uneven surface of the conductive film that is formed on the peripheral wall may degrade the performance of the waveguide tube.

On the other hand, an array of plural via holes or through holes may be formed as a peripheral wall of the hole instead of the conductor film, as disclosed in JP-P2001-196815A. The array of via holes must be formed on the dielectric substrate at a certain distance (e.g. 0.5 mm) from the edge or the peripheral wall of the hole in order to secure the mechanical strength thereof. However, this distance may also degrade the performance of the waveguide tube.

SUMMARY OF THE INVENTION

Therefore, an object of the invention is to provide an improved dielectric substrate for a waveguide tube and a transmission line transition.

Another object is to omit a step of forming a flat conductive layer on the through hole.

According to a feature of the invention of a dielectric substrate used for a waveguide tube to transmit an electromagnetic wave whose wave length is $\lambda g$, the dielectric substrate has a hole and a plurality of via holes disposed to surround the hole at a distance $\delta$ that is equal to an integer $n\times$the wave length $\lambda g/2$ from the peripheral wall of the hole.

Therefore, a waveguide tube of good performance and mechanical strength can be provided without any additional step.

Preferably, the via holes are disposed at equal intervals each of which is less than $\lambda g/4$.

Another object of the invention is to provide an improved waveguide tube that includes a stack of a plurality of dielectric substrates constructed as above.

Another object of the invention is to provide a transmission line transition, which includes a waveguide tube section having a waveguide tube formed of at least the above dielectric substrate and a line transition section formed of at least the above dielectric substrate disposed adjacent the waveguide tube section to cover the hole, a transmission line for transmitting the electromagnetic wave, and an antenna pattern that is disposed in the hole to be electromagnetically coupled with the transmission line.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

The present invention will be described with reference to the appended drawings.

A dielectric substrate 1 according to the first embodiment of the invention will be described with reference to FIGS. 1A and 1B, FIGS. 2A and 2B and FIG. 3.

Figure 1A:
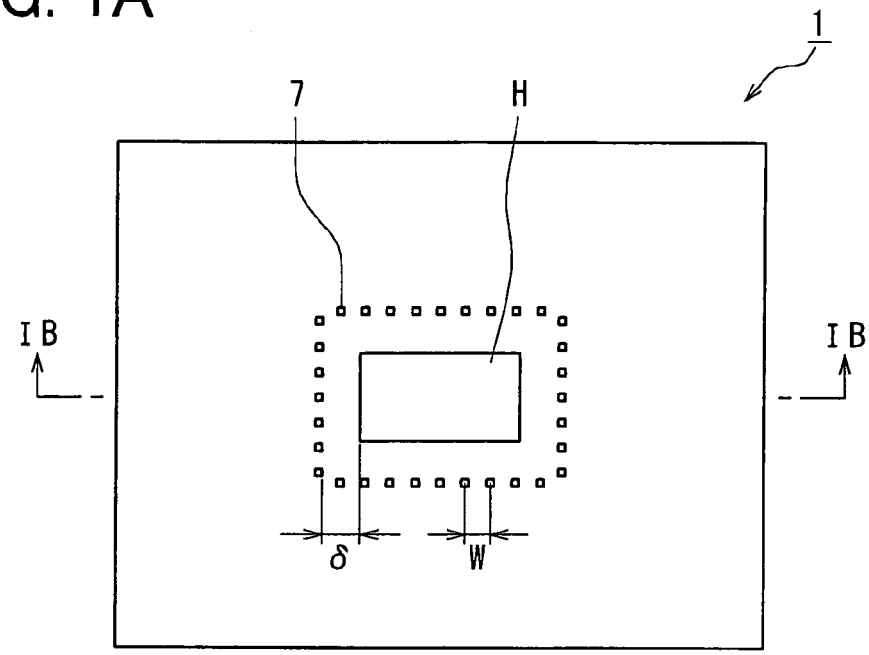
FIGS. 1A and 1B are a schematic plan view and a cross-sectional view of a dielectric substrate according to the first embodiment of the invention.
Figure 1B:
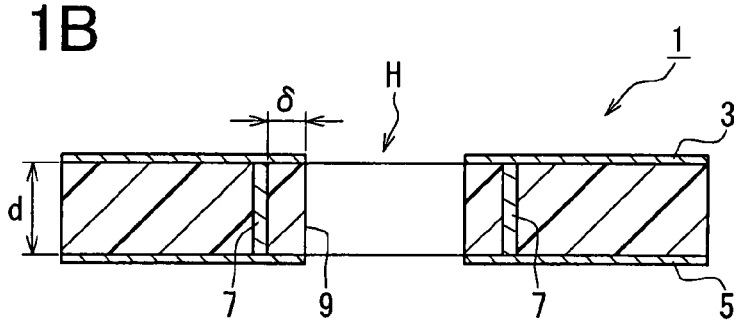

The dielectric substrate 1 has conductive layers 3, 5 (FIG. 1B) respectively formed on the upper and lower surfaces thereof, each of which has a ground pattern, a signal line pattern. The dielectric substrate 1 also has a thickness d (e.g. about 100 μm) and a rectangular hole H whose size (e.g. 2.54 mm×1.27 mm) is substantially the same as the hole of a waveguide tube for transmitting electromagnetic wave of a certain frequency band (e.g. 75-110 GHz) as shown in FIG. 1B.

Plural via holes 7 are formed at equal intervals W (FIG. 1A) in a belt portion of the dielectric substrate 1 at a distance $\delta$ (FIGS. 1A, 1B) from the wall 9 (FIG. 1B) of the hole H. Assuming that the wave length of the transmission signal is $\lambda g$, the distance $\delta$ is designed to be $\lambda g/2$ and the interval W is designed to be less than $\lambda g/4$. In case of the frequency of the transmission signal being 76.5 GHz, for example, the distance $\delta$ is 0.65 mm and the Interval W is 0.4 mm.

Because the dielectric substrate 1 does not have a conductive layer on the peripheral wall 9 of the hole H, the dielectric substrate 1 and a waveguide tube can be manufactured at a lower cost than a dielectric substrate having a conductive layer on the peripheral wall 9.

The hole H of the dielectric substrate 1 can be used for a waveguide tube by grounding the conductive layers 3, 5 that are connected with the via holes 7. The wall 9 of the hole H, which is distant from the grounded via holes at λg/2, can be treated as being virtually short-circuited. Because the via holes are formed at intervals of W that is shorter than λg/4, a waveguide tube of a low loss can be provided.

Figure 2A:
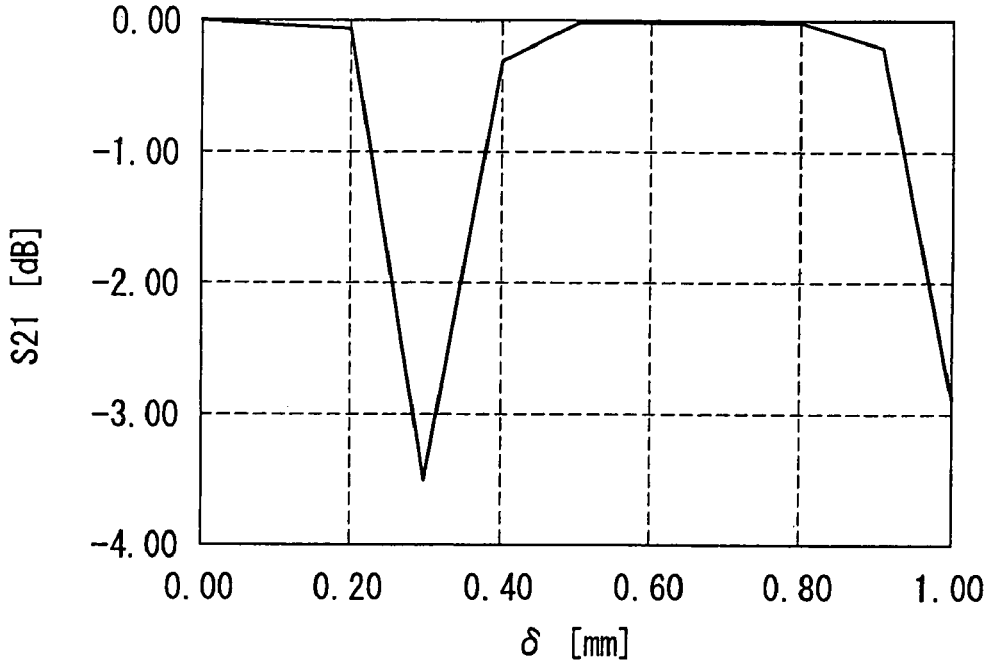
FIGS. 2A and 2B are graphs showing transmittance characteristics of the waveguide.

As shown in FIG. 2A, the transmittance characteristic S21 of the waveguide tube becomes maximum if the via holes are formed at distance δ from the peripheral wall 9 being about 0.65 mm, which is λg/2. That is, the dielectric loss of the waveguide tube is minimum.

Figure 2B:
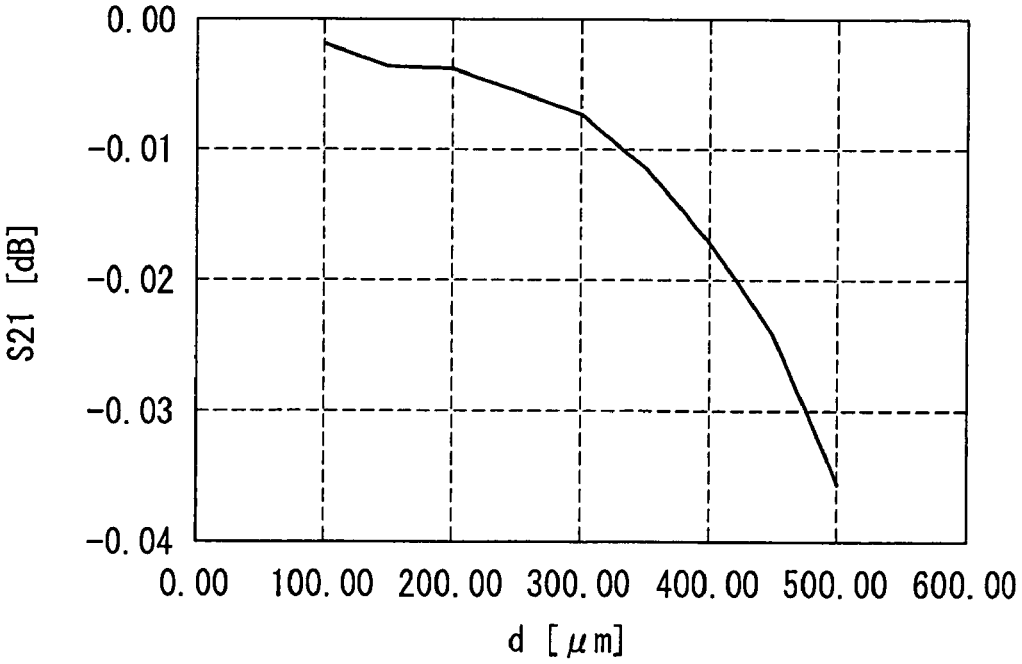

As shown in FIG. 2B, the transmittance characteristic S21 of the waveguide tube decreases by about 0.035 db when the thickness of the dielectric substrate changes from 100 μm to about 500 μm, which is five times as thick as 100 μm. In other words, the dielectric loss does not increase much even if the thickness d of the dielectric substrate increases by a certain degree.

Figure 3:
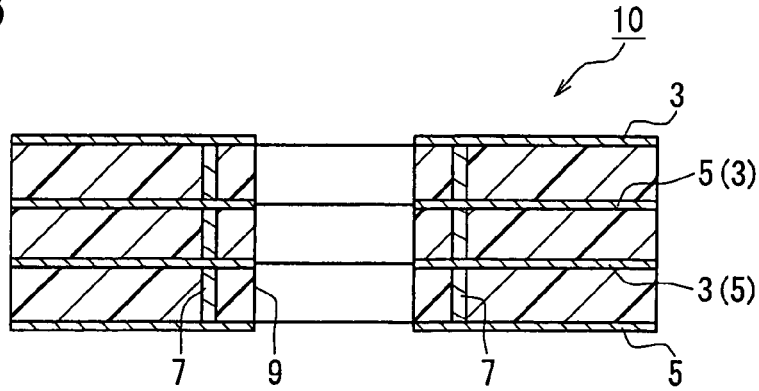
FIG. 3 is a schematic cross-sectional view of a stack of the dielectric substrates.

Therefore, a dielectric substrate 10 may be formed of a stack of plural dielectric substrates, as shown in FIG. 3 where the sandwiched conductive layers 3 and 5 become conductive layer 3(5) and 5(3).

A transmission line transition 20 according to the second embodiment of the invention will be described with reference to FIGS. 4A and 4B and FIG. 5A-5D.

Figure 4A:
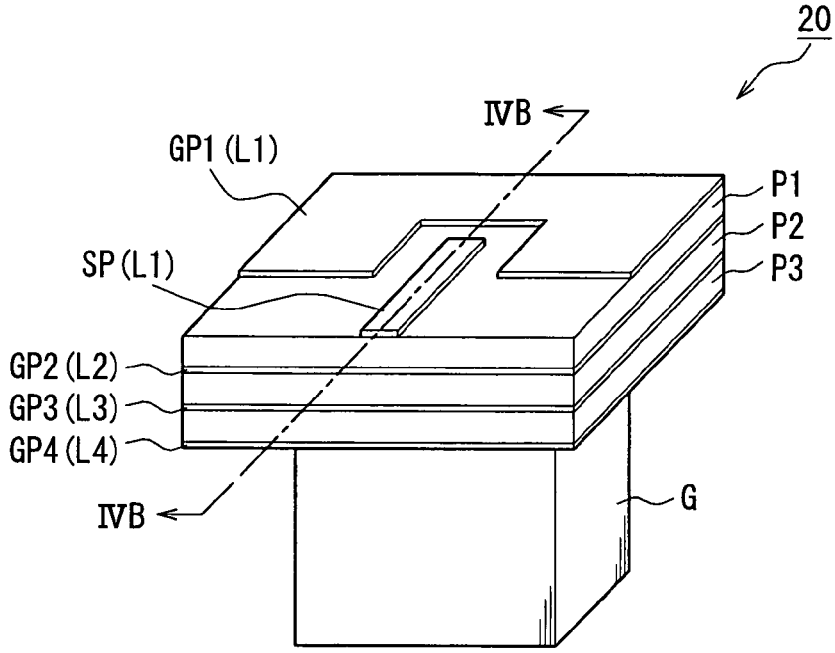
FIGS. 4A and 4B are a schematic perspective view of a transmission line transition according to the second embodiment of the invention and a cross-sectional side view of the transmission line transition according to the second embodiment cut along line IVB-IVB.
Figure 4B:
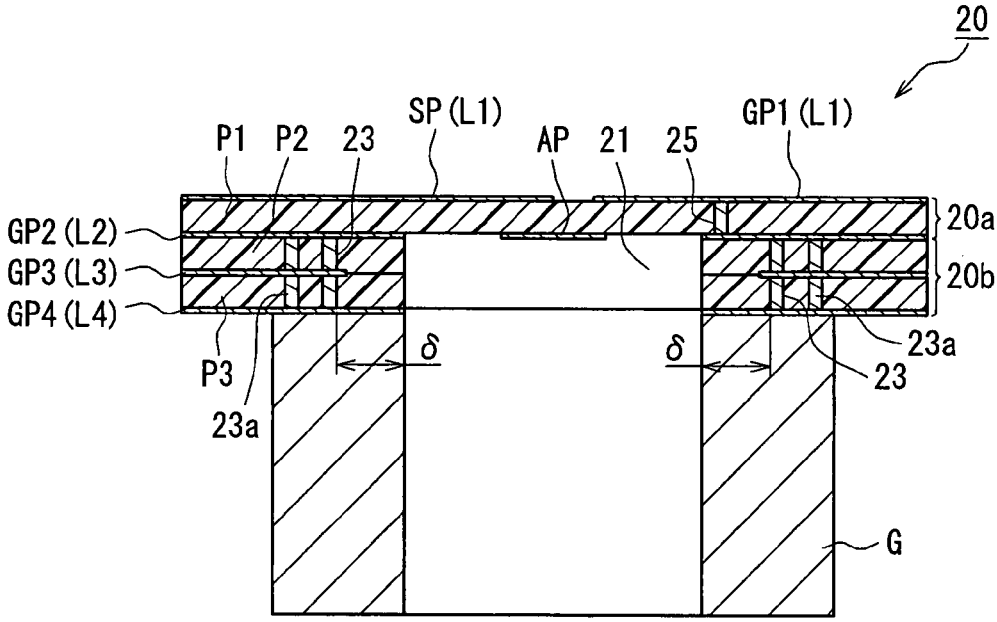

The transmission line transition 20 is constructed of three dielectric substrate P1, P2 and P3 and four pattern layers L1, L2, L3 and L4 that are interleaved with each other, so that the dielectric substrate P1 and the pattern layers L1, L2 form a line transition section 20*a* (FIG. 4B), and so that the dielectric substrates P2, P3 and the pattern layers L2, L3 and L4 form a waveguide tube section 20*b* (FIG. 4B).

The transmission line transition 20 has a rectangular cavity 21 that extends along the center axis of the waveguide tube section 20*b* to be connected to a waveguide tube G, which is fixed to the waveguide tube section 20*b*. The waveguide tube G has a rectangular hole of 2.54 mm×1.27 mm to transmit an electromagnetic wave of a frequency between 75 GHz and 110 GHz (e.g. 76.5 GHz).

The waveguide tube section 20*b* has plural via holes 23 (FIG. 4B) formed in the dielectric substrates P2, P3 and the pattern layers L2, L3 and L4 at a distance (via-shift) δ from the peripheral wall of the rectangular cavity or hole 21 formed in the dielectric substrates P2, P3. The distance δ is 0.65 mm, which is λg/2.

The pattern layers L1, L2, L3 and L4 are shown in FIGS. 5A, 5B, 5C and 5D, respectively. The pattern layer L4, which is formed on the side of the dielectric substrate P3 to which the waveguide tube G is fixed, has a ground pattern GP4 that covers the entire surface of the dielectric substrate P4 except for the cavity 21.

The pattern layer L3, which is formed between the dielectric substrates P2 and P3, has a ground pattern GP3 that covers the entire surfaces of the dielectric substrates P2, P3 confronting each other except for the surfaces inside the via holes 23, and the pattern layer L2, which is formed between the dielectric substrates P1 and P2 or between the line transition section 20*a* and the waveguide tube section 20*b*, has a ground pattern GP2 that covers the entire surfaces of the dielectric substrates P1, P2 confronting each other except for the surface inside the via holes 23 and an antenna pattern AP disposed at the bottom of the cavity 21.

Figure 5A:
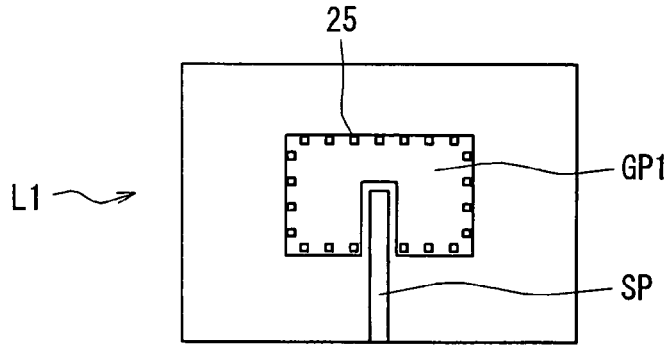
FIGS. 5A-5D respectively illustrate pattern layers.
Figure 5B:
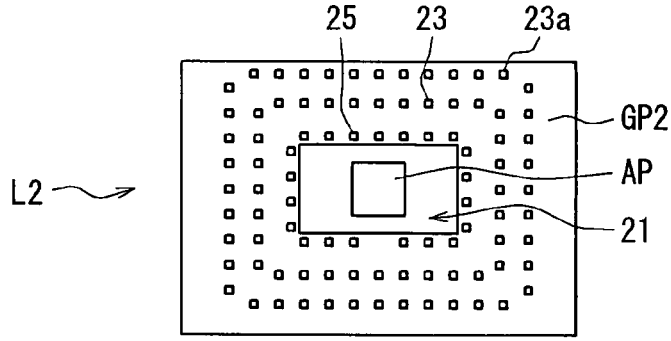
Figure 5C:
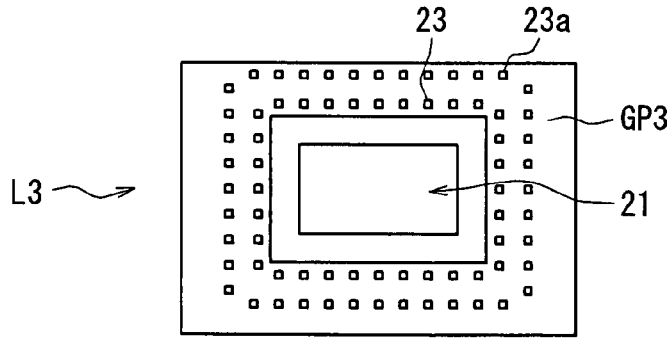
Figure 5D:
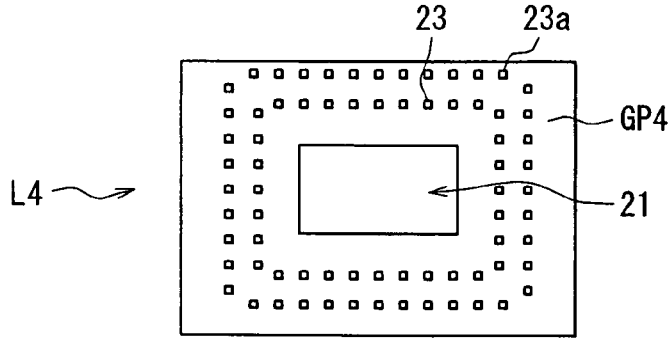

Referring to FIG. 5A, the pattern layer L1, which is formed on the outside surface of the dielectric substrate P1, includes a transmission line SP (e.g. a strip line, a micro-strip line, a coplanar line, or the like.) that has an end disposed to confront the antenna pattern AP and a ground pattern GP1 that is disposed to be electrically separated from the antenna pattern AP and to cover the circumference of the cavity 21. The ground pattern GP1 and the ground pattern GP2 are connected with each other by via holes 25. Incidentally, the transmission line SP may be coupled to the antenna pattern AP by the via holes 25. The via holes 25 are located nearer to the cavity 21 than the via holes 23 to decrease dielectric loss.

The via holes 23 and 25 are respectively formed to align at intervals W that is equal to λg/4 or smaller. In other words, in the transmission line transition 20, the waveguide tube section 20*b* is substantially the same in construction as the dielectric substrate according to the first embodiment. Another array of via holes 23*a* (FIGS. 4B, 5B-5D) is formed to surround the via holes 23, 24 at a distance λg/4. The distance between the array of the via holes 23 and the array of the via holes 23*a* is less than λg/2. Therefore, electromagnetic waves that pass through the array of via holes 23 are reflected by the via holes 23*a*. The electromagnetic wave that is reflected by the array of the via holes 23*a* are returned to the cavity 21 without being reflected by the array of via holes 23. Therefore, significant dielectric loss can be prevented.

Referring to FIG. 4B, the line transition section 20*a* covers one end of the waveguide tube section 20*b* so that the antenna pattern AP, which is electromagnetically coupled with the transition line SP, can be formed inside the waveguide tube. The antenna pattern AP has a shape and a size and is located so that conversion loss can be minimum.

Thus, the peripheral wall of the cavity 21 of the transmission line transition 20 that is formed in the dielectric substrates P1 and P2 is distant from the via holes 23 by a via-shift δ (λg/2) so that it can be treated as being short-circuited. Therefore, the loss of the waveguide tube section 20*b* can be minimized.

As described above, because the dielectric loss does not increase much even if the thickness of the dielectric substrate increases by a certain degree, the thickness of the dielectric substrates P1, P2 and P3 can be changed under various conditions.

Figure 6A:
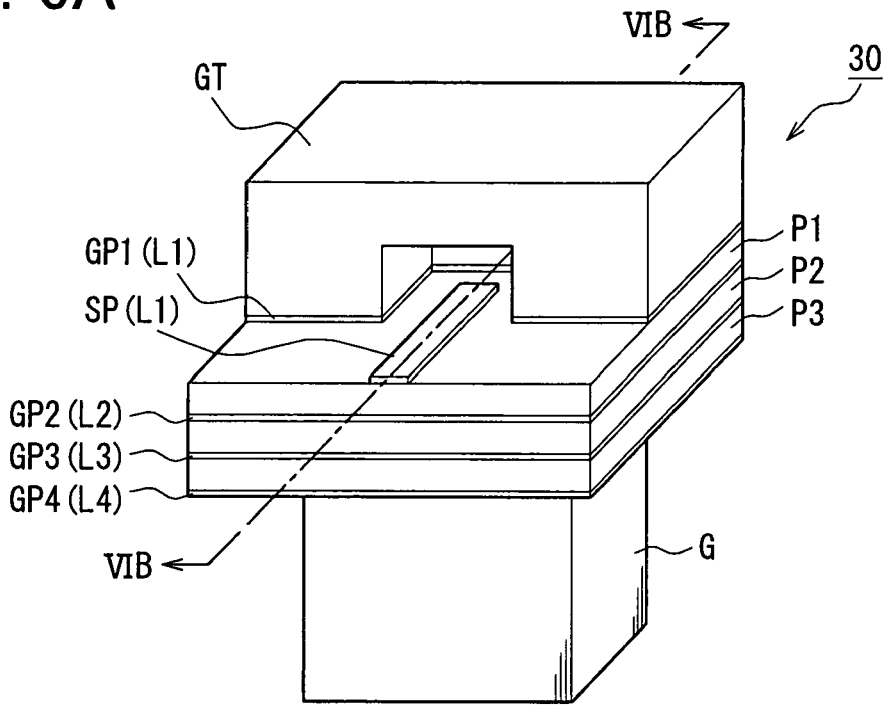
FIG. 6A is a schematic perspective view of a transmission line transition according to the third embodiment of the invention.

A transmission line transition 30 according to the third embodiment of the invention will be described with reference to FIGS. 6A and 6B.

Figure 6B:
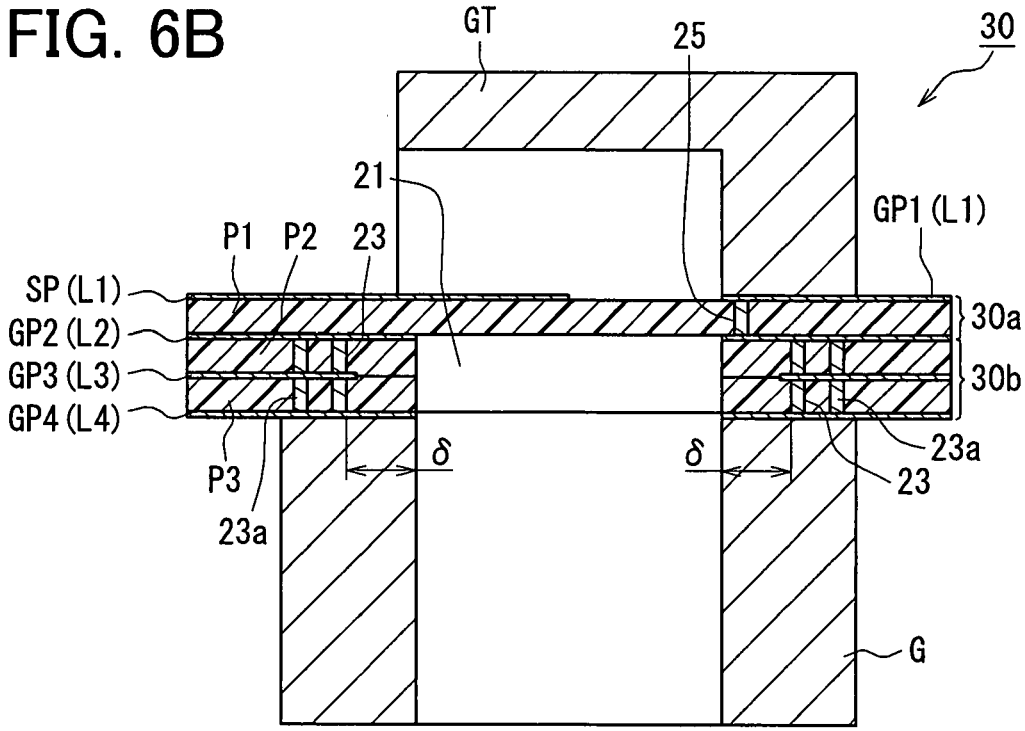
FIG. 6B is a cross-sectional side view of the transmission line transition shown in FIG. 6A cut along line VIB-VIB.

The transmission line transition 30 is constructed of three dielectric substrates P1, P2 and P3 and four pattern layers L1, L2, L3 and L4 that are interleaved with each other, so that the dielectric substrate P1 and the pattern layers L1, L2 form a line transition section 30*a* (FIG. 6B), and so that the dielectric substrates P2, P3 and the pattern layers L2, L3 and L4 form a waveguide tube section 30*b* (FIG. 6B). The waveguide tube section 30*b* is the same as the waveguide tube section 20*b* of the second embodiment.

The line transition section 30*a* is formed of the dielectric substrate P1 and the pattern layers L1 and L2. The pattern layer L2 has a ground pattern GP2 that covers the entire surfaces of the dielectric substrates P1, P2 confronting each other except for the surface inside the via holes 23. The antenna pattern AP, which is disposed at the bottom of the cavity 21 in the second embodiment, is omitted.

The pattern layer L1, which is formed on the outside surface of the dielectric substrate P1, includes the transmission line SP and the ground pattern GP1 that is disposed to be electrically separated from the transmission line SP and to cover the circumference of the cavity 21. A short-circuiting waveguide tube GT is fixed to the ground pattern GP1 so as to short circuit one end of the waveguide tube. The transmission line SP is about λg/4 distant from the short-circuiting end of the waveguide tube GT. The distance may be ±20% shorter or longer than the distance λg/4.

The above transmission line transition 30 is the same in construction as the transmission line transition 20 according to the second embodiment except for the line transition section 30*a*. Incidentally, the arrangement, in which the inside surface of the short-circuiting waveguide tube GT is formed on the same plane of the inside surface of the waveguide tube, the via holes 23 (FIG. 6B) are formed under the short-circuiting waveguide tube GT the along the inside surface thereof.

Figure 7:
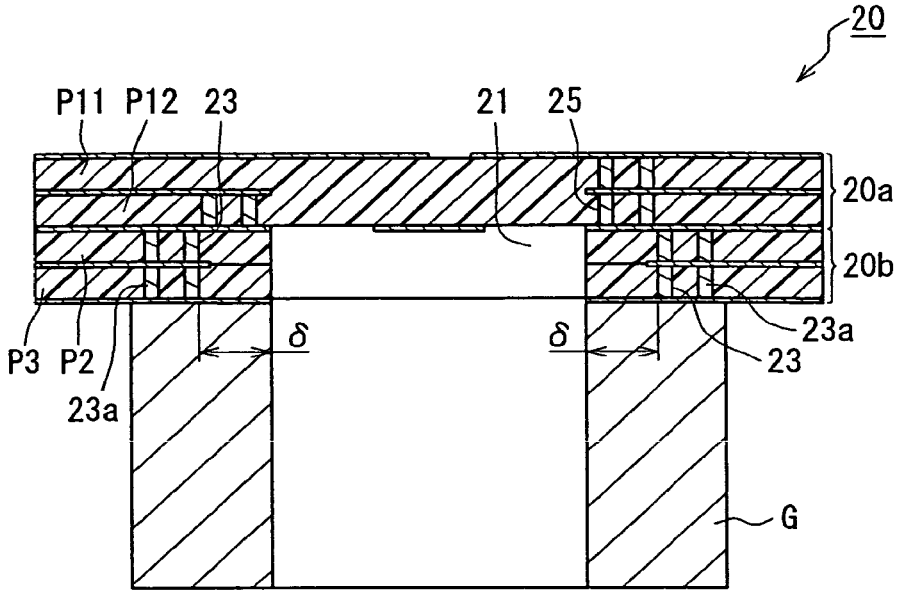
FIG. 7 is a schematic side view of a transmission line transition that is a variation of the second embodiment.
Figure 8:
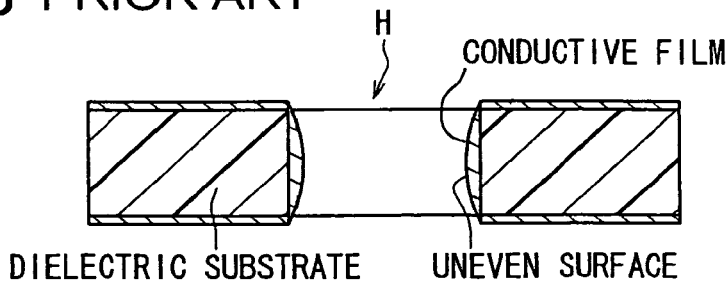
FIG. 8 PRIOR ART
FIG. 8 is a schematic cross-sectional view of a prior art dielectric substrate.

According to the invention, the following variations of the above embodiments can be made: the via-shift δ may be an integral multiple of λ/2, that is n×λ/2; the dielectric substrate P1 may be formed of plural dielectric substrates P11, P12, as shown in FIG. 7; the waveguide tube section 20*b* or 30*b* may be formed from one dielectric substrate or from three or more dielectric substrates; and/or the via holes 25 are formed in double arrays nearer to the cavity 21 than the via holes 23 or at a distance less than a half of the wave length in the dielectric substrate, as shown in FIG. 7, to reduce the dielectric loss.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A transmission line transition for transmitting an electromagnetic wave having a wave length of λg comprising:

a waveguide tube;

a waveguide tube section comprising a plurality of stacked first dielectric substrates, the waveguide tube section having a hole that forms a cavity connected with the waveguide tube and a plurality of first via holes lined to surround the cavity at a distance δ=n×λg/2 from the peripheral wall of the cavity to penetrate the plurality of stacked first dielectric substrates when n is an integer; and a line transition section comprising a plurality of second dielectric substrates having an antenna pattern disposed on a first side of the line transition section facing the waveguide tube and a horizontal transmission line disposed on a second side of the line transition section opposite to the first side, the plurality of second dielectric substrates being disposed to close one end of the waveguide tube section so that the antenna pattern is electromagnetically coupled with the horizontal transmission line; wherein an entire peripheral wall of the cavity does not have a conductive layer due to the plurality of first via holes that penetrate the plurality of first stacked dielectric substrates;

one of the second plurality of dielectric substrates has ground patterns formed on opposite surfaces thereof;

second via holes are disposed nearer to the cavity than the first via holes to connect the ground patterns formed on the opposite surfaces of the one of the plurality of second dielectric substances; and the line transition section further comprises a plurality of third via holes that surrounds the second via holes at a distance less than λg/4.

2. A transmission line transition as in claim 1, wherein the plurality of first via holes are lined at intervals each of which is less than λg/4.

3. A transmission line transition for transmitting an electromagnetic wave having a wave length of λg comprising:

a waveguide tube;

a waveguide tube section comprising a plurality of stacked first dielectric substrates, the waveguide tube section having a hole that forms a cavity connected with the waveguide tube and a plurality of first via holes lined to surround the hole at a distance δ=n×λg/2 from the peripheral wall of the hole to penetrate the plurality of stacked first dielectric substrates when n is an integer; and a line transition section comprising at least a second dielectric substrate having an antenna pattern disposed on a first side of the line transition section facing the waveguide tube and a horizontal transmission line disposed on a second side of the line transition section opposite to the first side, the second dielectric substrate being disposed to close one end of the waveguide tube section so that the antenna pattern is electromagnetically coupled with the horizontal transmission line, wherein:

each of the plurality of stacked first dielectric substrates has ground patterns on the opposite surfaces thereof;

an entire peripheral wall of the cavity being free of a conductive layer due to the plurality of first via holes that penetrate the plurality of first stacked dielectric substrates;

the at least a second dielectric substrate comprises a plurality of second dielectric substrates;

one of the plurality of second dielectric substrates has ground patterns disposed on opposite surfaces thereof;

second via holes are disposed nearer to the cavity than the first via holes to connect the ground patterns disposed on the opposite surfaces of the one of the plurality of second dielectric substrates; and the line transition section further comprises a plurality of third via holes that surrounds the second via holes at a distance less than λg/4.

4. A transmission line transition as in claim 3, wherein the plurality of first via holes are lined at intervals each of which is less than λg/4.

* * * * *